US012522255B2

(12) United States Patent
Peterson et al.

(10) Patent No.: US 12,522,255 B2
(45) Date of Patent: Jan. 13, 2026

(54) APPARATUS AND METHOD FOR MAINTAINING THE INTERIOR OF A BRIDGING ELEMENT THAT INTERCONNECTS EVACUATED TUBES OF A TRANSPORTATION SYSTEM

(71) Applicant: Flowserve Pte. Ltd., Singapore (SG)

(72) Inventors: John K. Peterson; Matthew W. Laney, Raleigh, NC (US)

(73) Assignee: Flowserve Pte. Ltd., Singapore (SG)

( * ) Notice: Subject to any disclaimer, the term of this patent is extended or adjusted under 35 U.S.C. 154(b) by 833 days.

(21) Appl. No.: 17/797,485

(22) PCT Filed: Jan. 26, 2021

(86) PCT No.: PCT/US2021/015071

§ 371 (c)(1),
(2) Date: Aug. 4, 2022

(87) PCT Pub. No.: WO2021/162850

PCT Pub. Date: Aug. 19, 2021

(65) Prior Publication Data

US 2023/0054554 A1 Feb. 23, 2023

Related U.S. Application Data

(60) Provisional application No. 62/975,817, filed on Feb. 13, 2020.

(51) Int. Cl.
*B61B 13/10* (2006.01)

(52) U.S. Cl.
CPC ..... *B61B 13/10* (2013.01)

(58) Field of Classification Search
CPC ..... B61B 13/10; Y02T 30/00
See application file for complete search history.

(56) References Cited

U.S. PATENT DOCUMENTS 2,973,894 A 3/1961 Kimball
3,006,288 A 10/1961 Brown
(Continued)

FOREIGN PATENT DOCUMENTS

CA 2780451 A1 12/2012
CN 109356647 A * 2/2019 ..... E21F 17/00
(Continued)

OTHER PUBLICATIONS

Notice of Allowance for U.S. Appl. No. 16/867,049 mail date Sep. 19, 2022, 44 pages.
(Continued)

*Primary Examiner* — Jason C Smith
(74) *Attorney, Agent, or Firm* — Maine Cernota & Curran

(57) ABSTRACT

A bridging module provides sealable interconnection between segments of an evacuated tube transportation system. A pair of gate elements are horizontally transitioned by a drive mechanism from a stored configuration offset from the tube segments to a deployed configuration where an expanding mechanism presses them outward to seal portals to the tube segments. The module can thereby be vented while the tube segments retain vacuum. A rail carriage in the module can bridge between overhead capsule support rails of the tube segments. A lifting mechanism can lift the rail carriage into a rail carriage section above the portals to allow the gate elements to deploy. The gate elements can be supported by rails and/or linear bearings, and pressed outward by opposed pneumatic pistons located between them, e.g. proximal to the four corners of the gate elements. The drive mechanism can include a motor with rack and pinion.

19 Claims, 7 Drawing Sheets

(56) References Cited

U.S. PATENT DOCUMENTS

| | | | | |
|---|---|---|---|---|
| 3,610,163 | A | 10/1971 | Edwards | |
| 3,820,740 | A | 6/1974 | Alexandrov | |
| 3,922,110 | A | 11/1975 | Huse | |
| 3,999,487 | A | 12/1976 | Valverde | |
| 4,225,288 | A | 9/1980 | Mugele | |
| 4,470,576 | A * | 9/1984 | Schertler | F16K 3/18 251/193 |
| 4,505,647 | A | 3/1985 | Alloca | |
| 4,699,570 | A | 10/1987 | Bohn | |
| 4,850,809 | A | 7/1989 | Smith | |
| 5,595,477 | A | 1/1997 | Amlinger | |
| 5,944,049 | A | 8/1999 | Beyer | |
| 6,004,109 | A | 12/1999 | Gebele | |
| 6,589,023 | B2 | 7/2003 | Royce | |
| 7,021,888 | B2 | 4/2006 | Jostlein | |
| 7,814,922 | B2 | 10/2010 | Tollner | |
| 10,094,381 | B2 | 10/2018 | Calhoun | |
| 10,286,928 | B1 | 5/2019 | Neophytou | |
| 2002/0138230 | A1 | 9/2002 | Faymon | |
| 2004/0079257 | A1 | 4/2004 | Scott Tidmarsh | |
| 2007/0295209 | A1 | 12/2007 | Strauser | |
| 2010/0116349 | A1 | 5/2010 | Fischer | |
| 2010/0270801 | A1 | 10/2010 | Liu | |
| 2011/0283914 | A1 | 11/2011 | Kwon | |
| 2014/0261054 | A1 | 9/2014 | Oster | |
| 2015/0260151 | A1 | 9/2015 | Kang | |
| 2016/0229297 | A1 | 8/2016 | Finodeyev | |
| 2016/0230899 | A1 * | 8/2016 | Cothern | F16K 27/044 |
| 2017/0138213 | A1 | 5/2017 | Olatunde | |
| 2017/0146136 | A1 | 5/2017 | Cothern | |
| 2017/0350632 | A1 | 12/2017 | Irao | |
| 2018/0180019 | A1 | 6/2018 | Jiang | |
| 2018/0281820 | A1 | 10/2018 | Grip | |
| 2018/0313324 | A1 | 11/2018 | Yeo | |
| 2019/0211661 | A1 | 7/2019 | Reckels | |
| 2019/0344806 | A1 | 11/2019 | Kalra | |
| 2020/0001897 | A1 | 1/2020 | Neophytou | |
| 2020/0083676 | A1 | 3/2020 | Rochin Machado | |
| 2020/0109705 | A1 | 4/2020 | Suzuki | |
| 2020/0122748 | A1 | 4/2020 | Grip | |
| 2020/0191109 | A1 | 6/2020 | Hector, Jr. | |
| 2023/0054554 | A1 * | 2/2023 | Peterson | B61B 13/10 |

FOREIGN PATENT DOCUMENTS

| | | | | |
|---|---|---|---|---|
| CN | 110203213 | A * | 9/2019 | B61B 13/10 |
| EP | 1544473 | A2 | 6/2005 | |
| EP | 4289700 | B1 * | 12/2024 | B61D 23/02 |
| GB | 1188836 | A * | 4/1970 | E01D 19/125 |
| JP | 48419 | B | 5/1970 | |
| JP | H07172579 | A | 7/1995 | |
| JP | 2004263681 | A | 9/2004 | |
| JP | 2009011182 | A * | 1/2009 | |
| JP | 2012180032 | A | 9/2012 | |
| KR | 20110069392 | A | 6/2011 | |
| KR | 101130807 | B1 | 3/2012 | |
| KR | 101920414 | B1 * | 11/2018 | F16K 3/314 |
| PL | 2945830 | T3 * | 4/2019 | B61D 23/00 |
| WO | 2009061443 | A1 | 5/2009 | |

OTHER PUBLICATIONS

Chinese Office Action for Chinese Patent Appl. No. 201980074548.1 mail date Aug. 19, 2022, 12 pages.

Office Action for Foreign Patent Application No. 202180014716.5 mail date Sep. 13, 2023, 6 pages.

Chinese Office Action for Patent Application No. 202180014716.2 mail date Mar. 12, 2024, 12 pages.

Extended European Search Report for Patent Application No. EP20934508.1 mail date May 26, 2023, 5 pages.

International Preliminary Report on Patentability for PCT Appl. No. PCT/US2021/015071 mail date Aug. 25, 2022, 7 pages.

Extended European Search Report for Patent Application No. EP21753704.2 mail date Jun. 23, 2023 8 pages.

Office Action Advisory for U.S. Appl. No. 17/863,591 mail date Jun. 7, 2024, 4 pages.

Office Action for U.S. Appl. No. 17/863,591 mail date Jun. 21, 2024, 14 pages.

Notice of Reasons for Refusal for Japanese Patent Application No. 2023-112239 mail date Jul. 5, 2024, 21 pages.

Office Action for EP application No. 23184819.3 mail date Jul. 30, 2024, 5 pages.

Transmittal of International Preliminary Report on Patentability mail date Nov. 17, 2022, 8 pages.

International Search Report and Written Opinion for PCT Appl. No. PCT/US2019/060049 mail date Apr. 9, 2020, 14 pages.

International Preliminary Report on Patentability for PCT Appl. No. PCT/US2019/060049, mail date May 27, 2021, 10 pages.

Extended European Search Report for Patent Appl. No. EP19885343.4 mail date Dec. 14, 2021, 7 pages.

Office Action Restriction for U.S. Appl. No. 16/675,854 mail date Feb. 22, 2022, 7 pages.

Office Action for U.S. Appl. No. 16/675,854 mail date May 24, 2022, 44 pages.

Hartranft, John; 1991; "GE LM2500 Marine Gas Turbine Experience"; The American Society of Mechanical Engineers, pp. 1-6 (Year: 1991).

Notice of Allowance for U.S. Appl. No. 16/675,854 mail date Aug. 15, 2022, 16 pages.

Corrected Notice of Allowance for U.S. Appl. No. 16/675,854 mail date Aug. 17, 2022, 13 pages.

International Search Report and Written Opinion for PCT Appl. No. PCT/US2020/031452, mail date Jan. 29, 2021, 12 Pages.

International Search Report and Written Opinion for PCT Appl. No. PCT/US2021/015071, mail date Apr. 28, 2021, 10 Pages.

Examination Report for Indian Patent Application No. 202217051749 mail date Oct. 15, 2025, 6 pages.

* cited by examiner

APPARATUS AND METHOD FOR MAINTAINING THE INTERIOR OF A BRIDGING ELEMENT THAT INTERCONNECTS EVACUATED TUBES OF A TRANSPORTATION SYSTEM

RELATED APPLICATIONS

This application is a national phase application filed under 35 USC § 371 of PCT Application No. PCT/US2021/015071 with an International filing date of Jan. 26, 2021, which claims the benefit of U.S. Provisional Application No. 62/975,817 filed Feb. 13, 2020. Each of these applications is herein incorporated by reference in its entirety for all purposes.

FIELD OF THE INVENTION

The invention relates to vacuum systems, and more particularly, to apparatus and methods for isolating and interconnecting very large evacuated volumes such as segments of an evacuated transportation system.

BACKGROUND OF THE INVENTION

The conventional methods of conveying groups of people over large distances can be categorized into four basic types: rail, road, water, and air. Transportation by road and water tends to be relatively inexpensive, but comparatively slow. Travel by air is much faster, but is expensive. Rail transportation of people can be both slow and expensive.

Several alternatives have been proposed for rapidly and economically conveying large numbers of people by transporting them in modules or "capsules" that are supported by rails and travel over long distances through specially prepared tubes that have been evacuated to eliminate air resistance. One example is supersonic or hypersonic transport of passenger capsules through evacuated underground tubes. According to this approach, often referred to as "hyperloop," capsules are propelled over long distances through a series of interconnecting transportation tubes or "segments" that are evacuated to reduce air friction past the capsules. The capsules can be conventionally suspended, or they can be magnetically levitated.

A common feature of these proposed "evacuated tube" transportation systems is that the evacuated tubes will be organized into segments that can be isolated from each other so that individual segments can be vented for maintenance without venting the entire tube. These tube segments have very large volumes, each segment being, for example, five meters in diameter and between 10 and 20 miles in length.

The very large scale of these tube segments gives rise to special challenges that must be overcome. For example, it is necessary to evacuate the segments as rapidly and efficiently as possible. Solutions directed to solving this problem are disclosed in related, co-pending U.S. application Ser. No. 16/675,854, also submitted by the present Applicant, which is incorporated herein by reference in its entirety for all purposes.

Another significant challenge is to find a way to join together adjacent tube segments, and to isolate selected tube segments as needed, so that they can be vented and maintained. One approach is to include a relatively narrow "bridging" segment between each pair of adjacent tube segments, to which the adjacent ends of the two tube segments can be attached and sealed. A large valve can be incorporated within the bridging segment, for example a valve having a gate element that can be raised and lowered to seal the passage that penetrates the bridging segment. Closing the gate valves at both ends of a segment thereby allows the segment to be vented while the other segments retain their vacuums.

However, this approach suffers from several shortcomings. For example, maintenance cannot be performed on the structures and apparatus that are located within the interior of the bridging segment without venting at least one, and possibly both, of the tube segments that are joined to it. Also, the requirement to reliably support the weight of the gate element as it is lifted and lowered poses significant engineering challenges, including requirements for a strong mechanical suspension system and a very powerful motor or motors that are able to lift the gate element, all of which can be costly and can cause the gate to consume large quantities of energy when in operation. A further challenge is the requirement to provide a gap in the rail or rails that support the transportation capsules, so that the gate element is able to pass through the rails when it is raised and lowered.

What is needed, therefore, is a system for interconnecting adjacent tube segments of an evacuated tube transportation system that can be maintained without venting either adjacent tube segment, that minimizes the challenges associated with supporting, opening, and closing a very large valve, and preferably that does not introduce a discontinuity into the transportation capsule support rail or rails.

SUMMARY OF THE INVENTION

The present invention is an evacuated tube transportation system tube segment bridging module that can be maintained without venting either adjacent tube segment, and that minimizes the challenges associated with supporting, opening, and closing a very large valve. In embodiments, the disclosed bridging module does not introduce any discontinuity into the transportation capsule support rail or rails.

The disclosed bridging module comprises a portal section that includes opposing portals that are configured for sealed attachment to adjoining tube segments. The bridging module further comprises two gate elements that slide horizontally between a storage configuration in which they do not overlap a passage formed between the portals, and a deployed configuration in which the gate elements fully overlap and seal the portals.

In addition, the bridging module includes an expanding mechanism that expands the gate elements away from each other when they are in the deployed configuration, so that the gate elements are pressed outwardly against the portals and form seals therewith. In embodiments, the expanding mechanism is a pneumatic system. For example, in embodiments the expanding mechanism includes four air-driven "opposed" double pneumatic pistons located proximal to and between four opposing "corners" of the gate elements.

Accordingly, when the gate elements are deployed and the expanding mechanism is engaged, both portals of the bridging module are fully sealed, so that the interior of the bridging module can be vented and accessed without any need to vent either of the adjoining tube segments.

Furthermore, the horizontal action of the gate elements enables their weight to be supported by a fixed support system such as rails, so that the deployment motor and drive mechanism need only be powerful enough to overcome the inertia of the gate elements and any frictional resistance of the support system. In embodiments, the drive mechanism includes a rack-and-pinion driven by a motor. The gate elements can be supported by linear bearings. Additional guide rails can be provided at the tops of the gate elements to maintain the stability of the gate elements, which can also engage with the gate elements via linear bearings.

In embodiments, the bridging segment further comprises a rail carriage that forms a connection between the capsule support rails of the adjoining tube segments. When the gate elements are deployed, the rail carriage is lifted vertically so that the gate elements and associated apparatus are able to pass beneath. And when the gate elements are returned to their storage locations the rail carriage is lowered back into position, where it re-engages with the capsule support rails of the adjacent tube segments. In embodiments, the rail carriage operates along vertical rails that run along both sides of a carriage housing that extends above the portals and forms part of the bridging module.

In embodiments, the motors that drive the gate elements and/or the rail carriage include continuous position indications and/or diagnostics that are remotely accessible, for example via Bluetooth. In embodiments, either or both of the gate elements and/or the rail carriage include limit switches that indicate fully open and closed positions. In embodiments the continuous position indications are calibrated according to signals received from the limit switches, as is described in more detail in co-pending U.S. application Ser. No. 15/648,959, also submitted by the present Applicant, which is incorporated herein by reference in its entirety for all purposes. Embodiments include redundant limit switches so that limits are not exceeded even if one of the limit switches fails.

It should be noted that while the present invention is disclosed and described in the context of evacuated tube transportation systems, the invention as such is not limited to transportation systems, but is applicable to any circumstance where it is necessary to interconnect and reversibly isolate adjacent, large, evacuated volumes.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
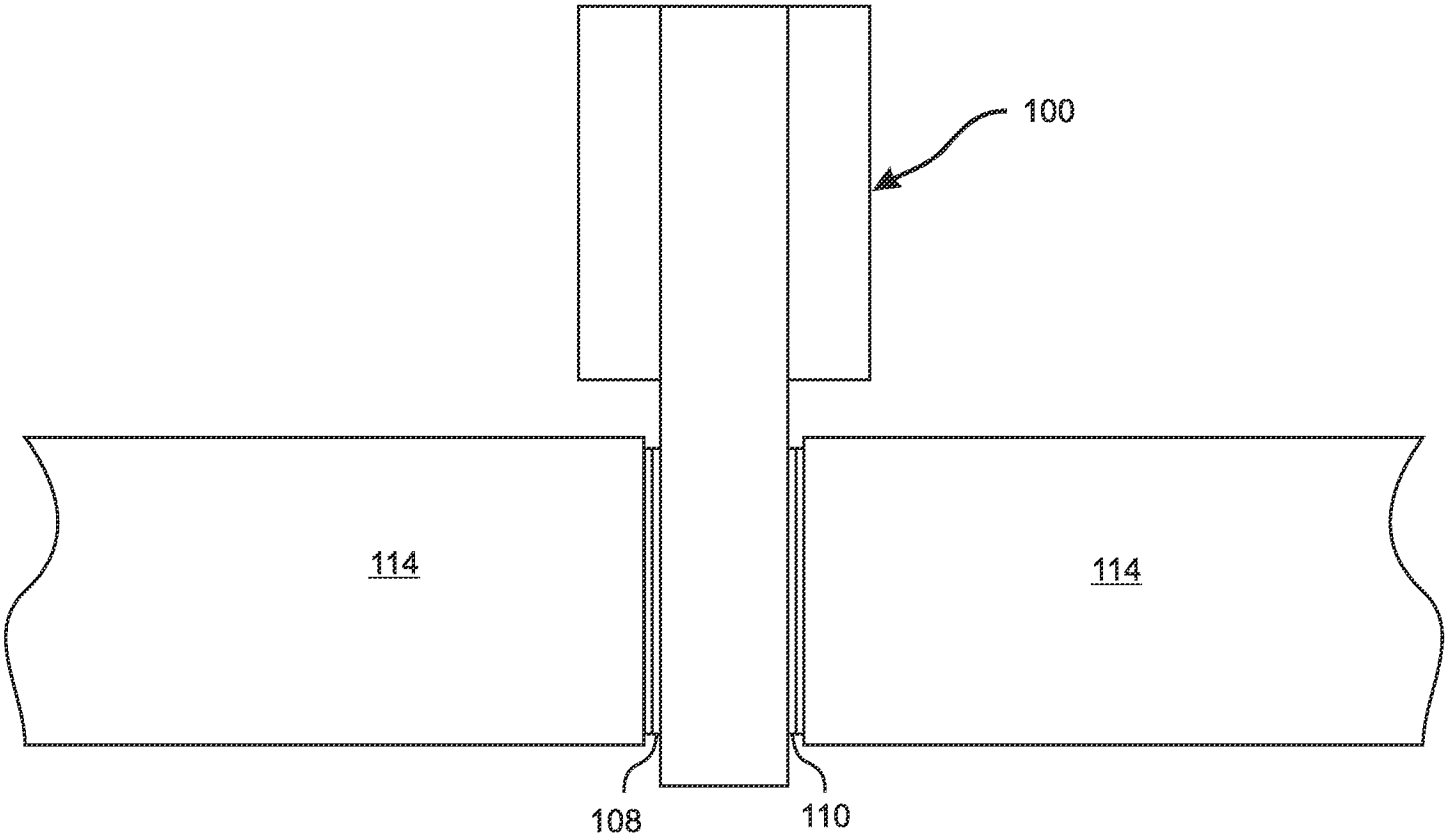
FIG. 1A is a view from above of a pair of evacuated transportation tube segments interconnected by a bridging module according to an embodiment of the present invention.

With reference to FIG. 1A, the present invention is a tube segment bridging module 100 that provides connectivity between two adjacent tube segments 114 of an evacuated tube transportation system. The bridging module 100 can be vented to atmosphere without venting either adjacent tube segment 114, and also minimizes the challenges associated with supporting, opening, and closing a very large valve. In embodiments, the disclosed bridging module 100 does not introduce any discontinuity into the transportation capsule support rail or rails of the evacuated tube transportation system.

Figure 1B:
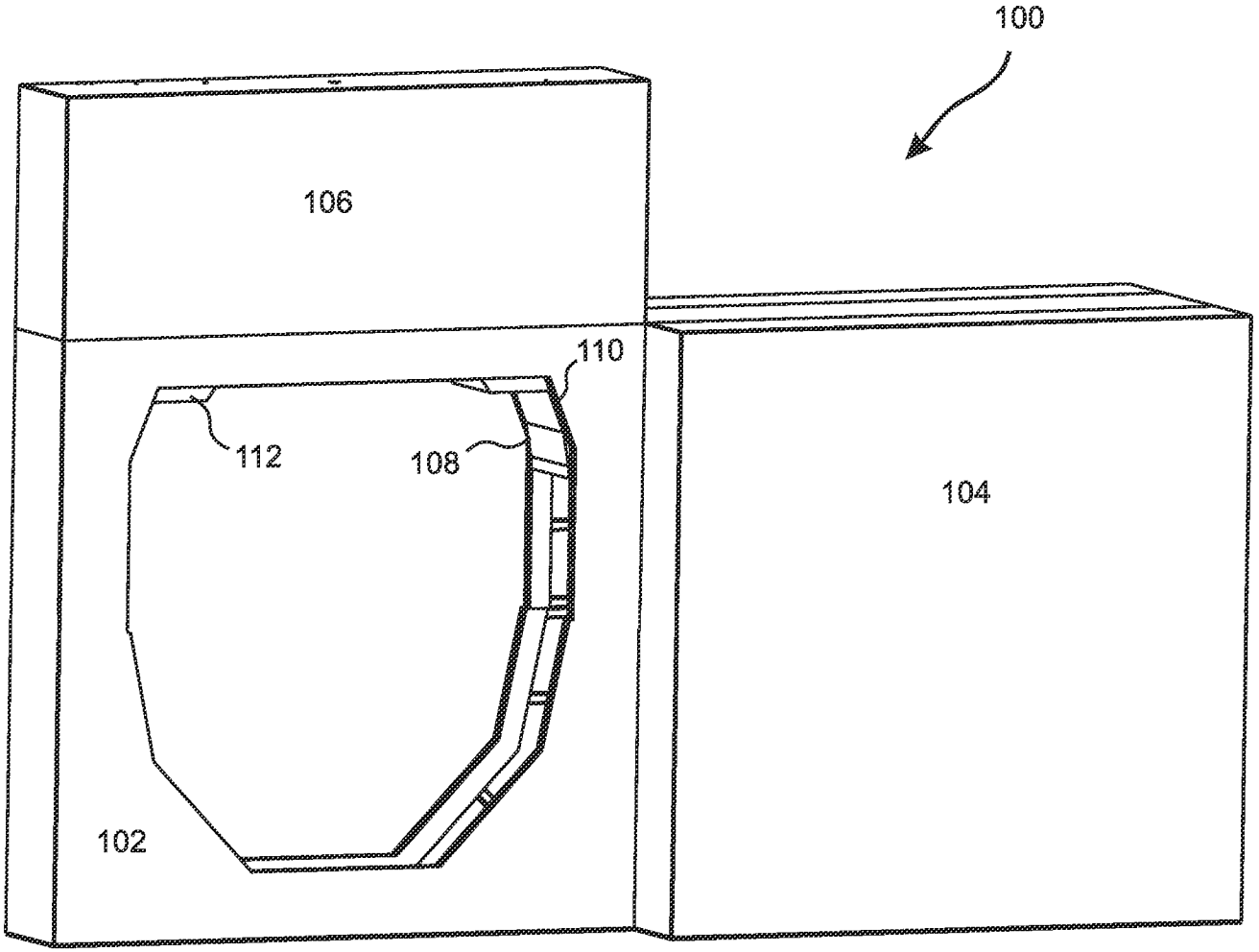
FIG. 1B is a front view of an embodiment of the present invention, drawn to scale.

With reference to FIG. 1B, the disclosed bridging module 100 comprises a portal section 102 that includes opposing portals 108, 110 configured for sealed attachment to adjoining tube segments 114, and a storage section 104. In the embodiment of FIG. 1, the bridging module 100 further includes a rail carriage section 106 as discussed in more detail below. Portions of a rail carriage 112 can be seen in the figure extending downward into a passage formed between the portals 108, 110. The rail carriage 112 forms a connection, in embodiments, between overhead rails that support transportation capsules in the adjacent evacuated transportation tube segments 114.

Figure 2A:
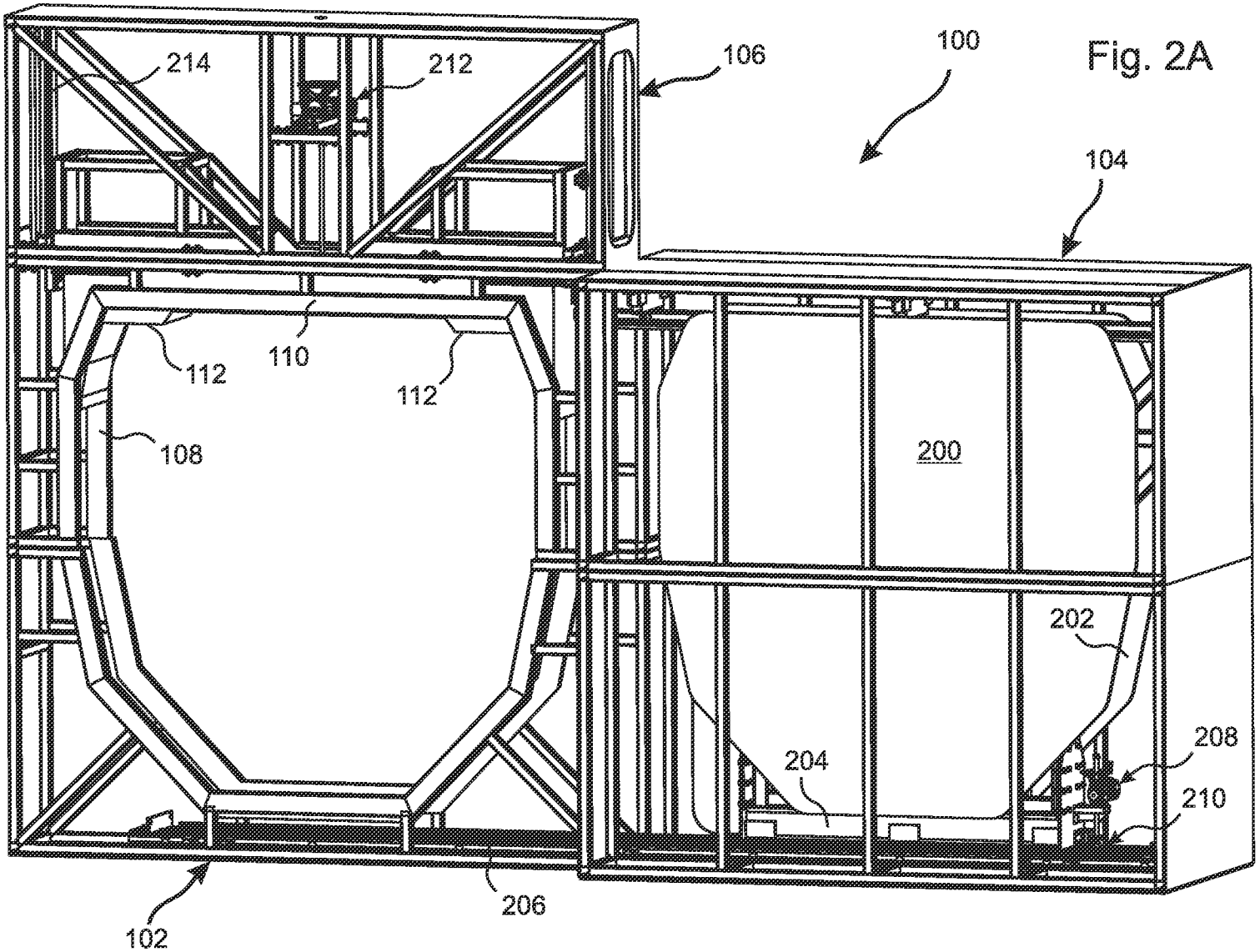
FIG. 2A is a front perspective view drawn to scale of the embodiment of FIG. 1 shown with its front and rear covers removed and the gate elements in their stored configuration.

FIG. 2A is a front perspective view of the embodiment of FIG. 1 in which the front, rear, and side panels have been removed. It can be seen in the figure that the bridging module further includes a pair of gate elements 200, 202 that are maintained in a parallel relationship to each other. The gate elements 200, 202 are configured to slide horizontally between a stored configuration in the storage section 104, as shown in FIG. 2A, where they do not overlap with the portals 108, 110, and a deployed configuration in the portal section, where the gate elements 200, 202 fully overlap the portals 108, 110 and can form a seal therewith, as is discussed in more detail below with reference to FIGS. 3A and 3B.

Figure 2B:
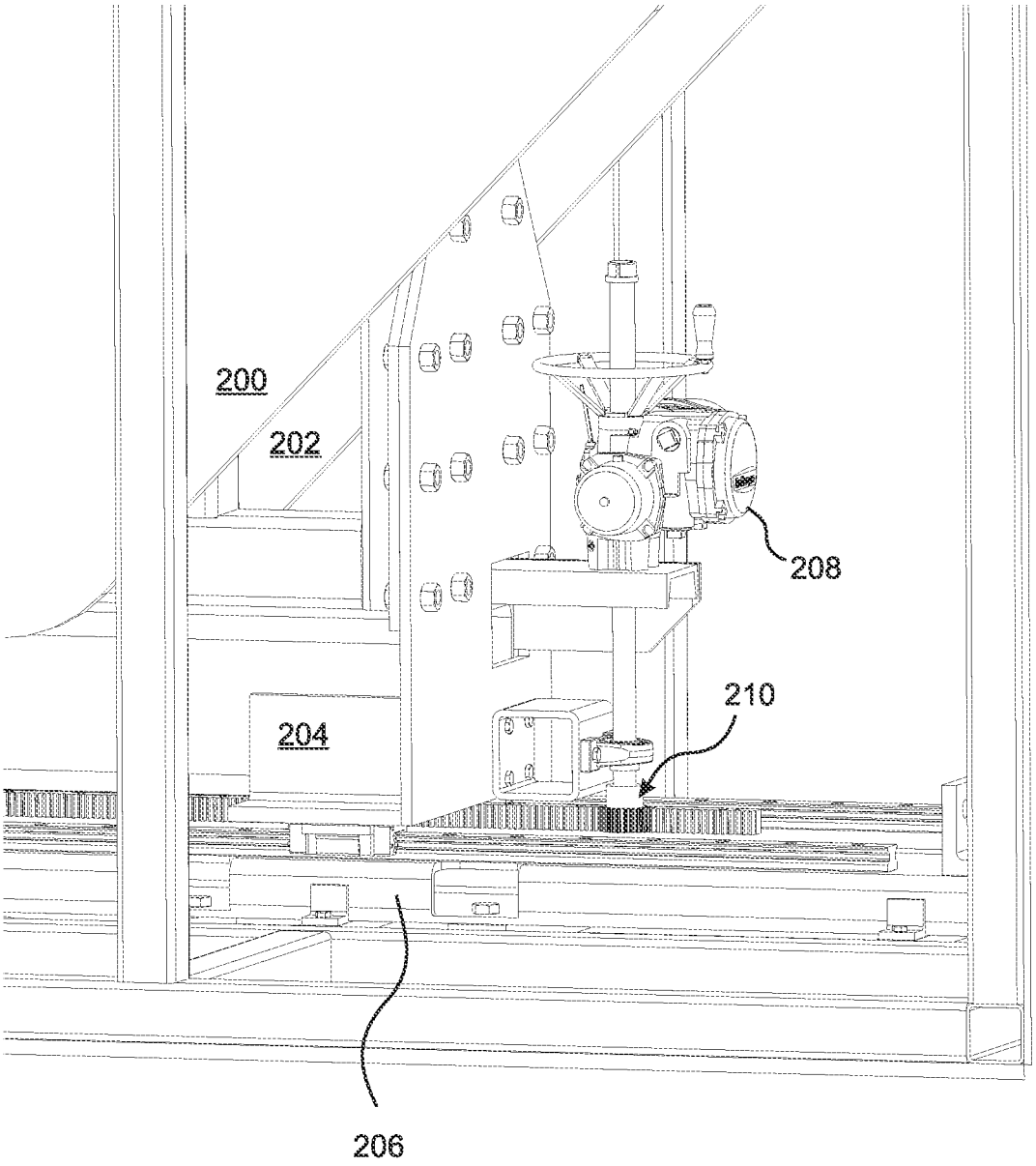
FIG. 2B is a close-up view drawn to scale of the drive mechanism of the embodiment of FIG. 2A.

With reference to FIG. 2B, the horizontal deployment of the gate elements 200, 202 enables their weight to be supported by a fixed support system such as by a carriage 204 that rests on rails and/or on linear bearings 206, so that the deployment motor 208 and drive mechanism 210 need only be powerful enough to overcome the inertia of the gate elements and any frictional resistance of the support system. In the embodiment of FIG. 2B, the drive mechanism 210 includes a rack-and-pinion driven by a motor. The tops of the gate elements 200, 202 can be supported by additional guide rails (elements 300 in FIG. 3A), which can also engage with the gate elements 200, 202 via linear bearings to maintain the stability of the gate elements 200, 202.

With reference again to FIG. 2A, it can be seen in the figure that the carriage section 106 includes a lifting mechanism 212 configured to lift the rail carriage 112 upward so that the gate elements 200, 202 can be moved into place beneath them to seal the portals 108, 110.

Figure 3A:
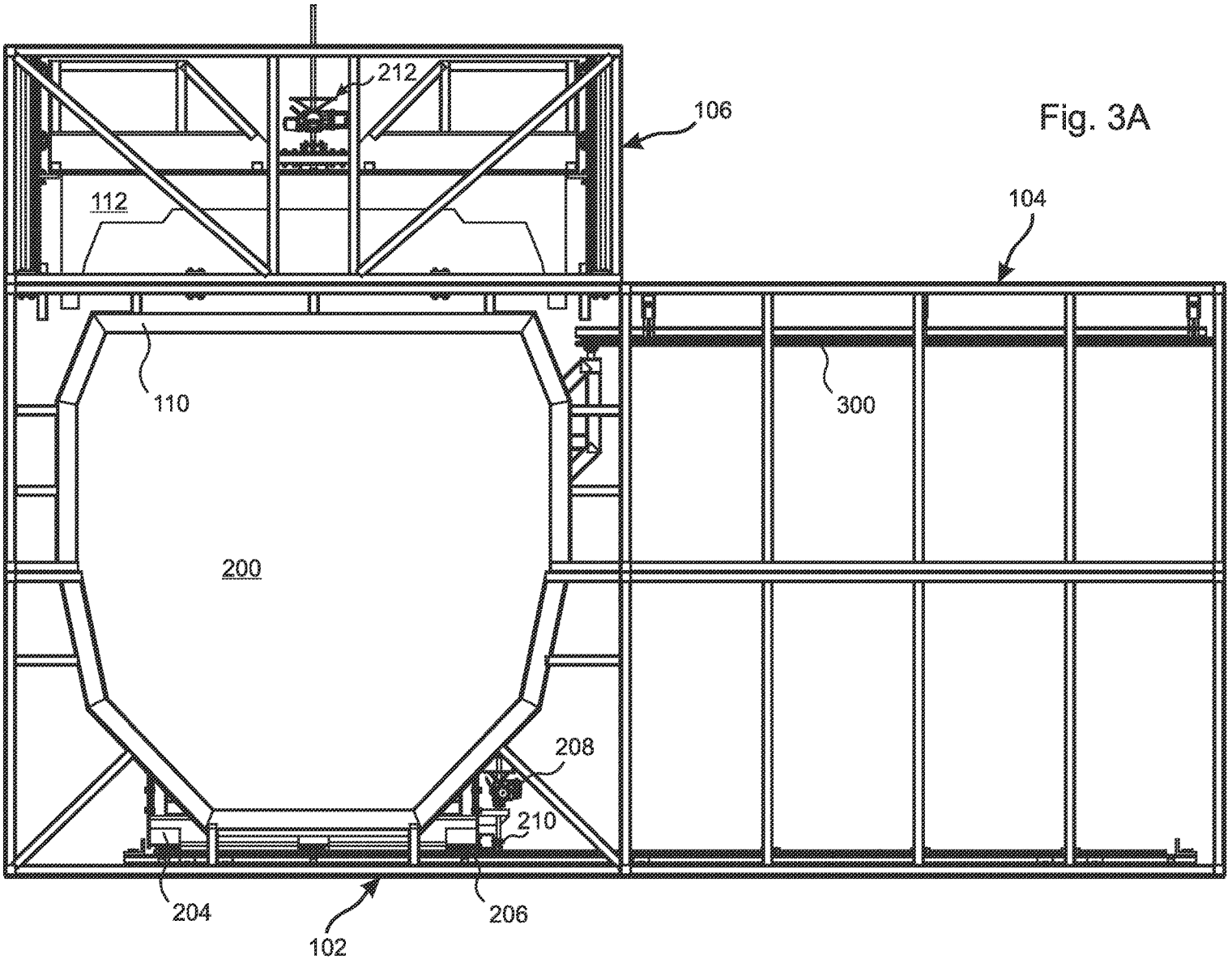
FIG. 3A is a front view drawn to scale of the embodiment of FIG. 2A shown with the gate elements in their deployed configuration.

FIG. 3A is a front view of the embodiment of FIGS. 1-2B, with the front panels removed, that shows the gate elements 200, 202 in their deployed configuration within the portal section 102 of the bridging module 100. It can also be seen in the figure that the rail carriage 112 has been lifted by the lifting mechanism 212 so that the gate elements 200, 202 and associated structure can be positioned underneath.

Figure 3B:
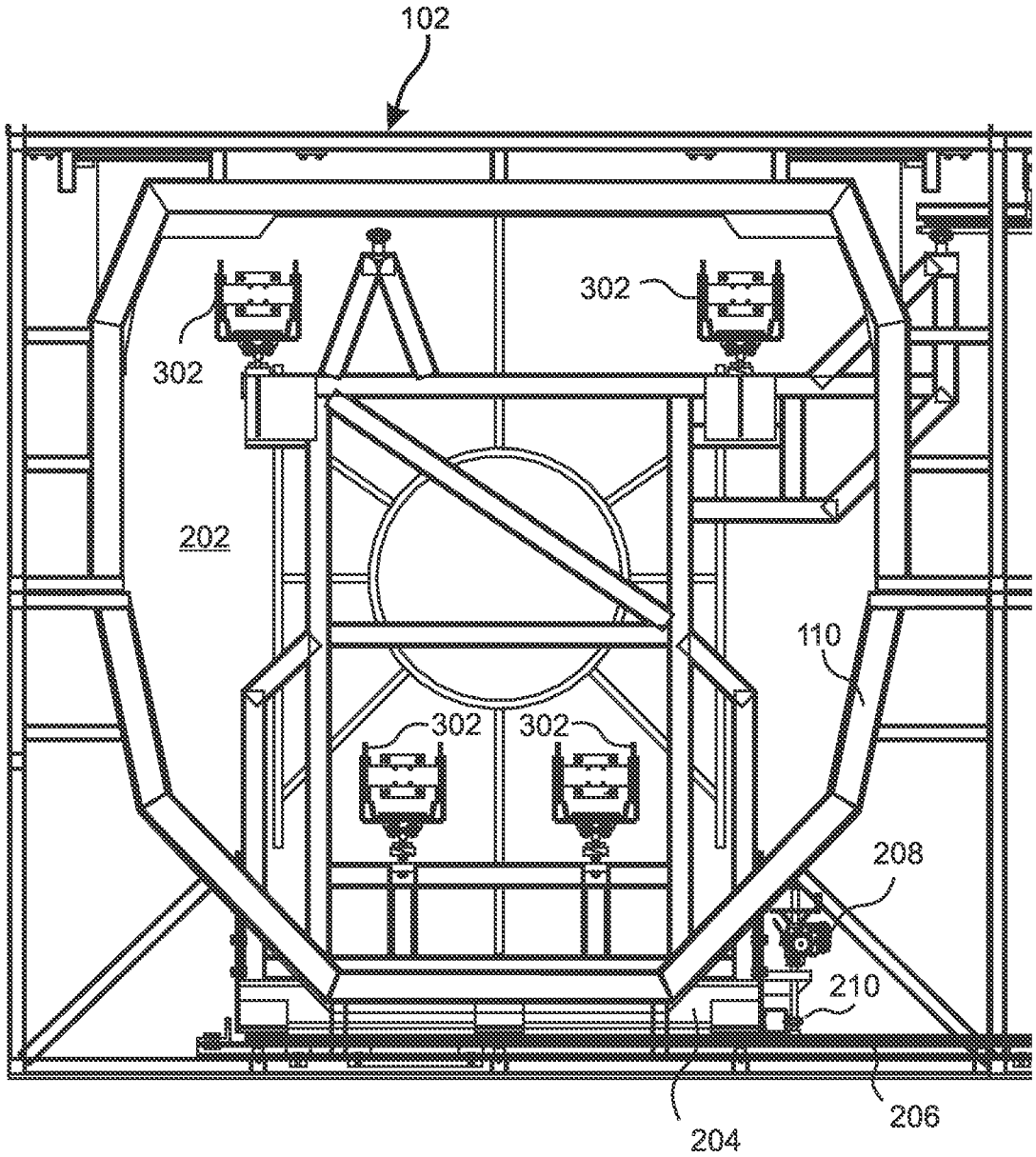
FIG. 3B is a front view drawn to scale of the embodiment of FIG. 3A shown with the front gate element removed.
Figure 3C:
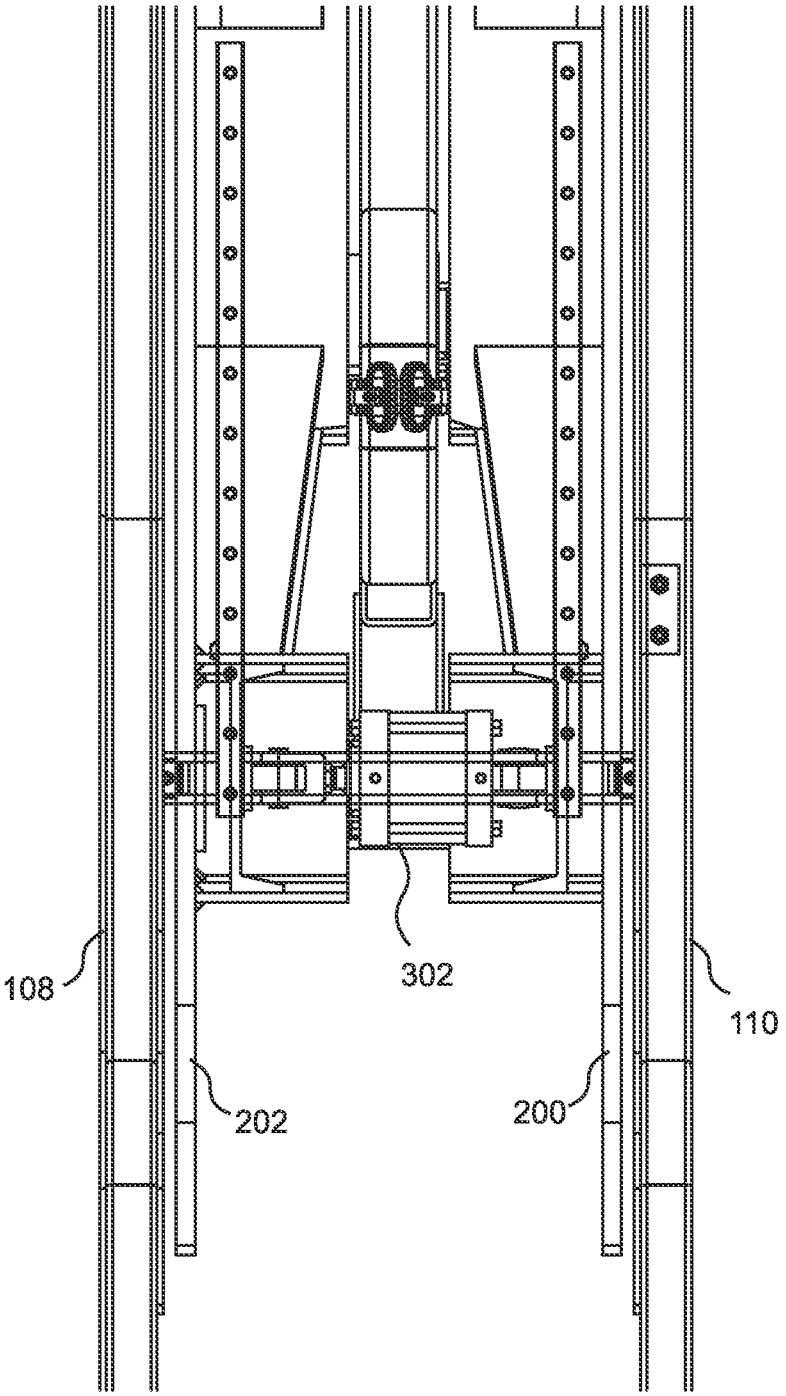
FIG. 3C is a top view drawn to scale of the embodiment of FIG. 3A shown with the top cover and other elements removed so that an opposed piston of the expanding mechanism is visible.

FIG. 3B presents a view that is similar to FIG. 3A, except that the nearer gate element 200 has been removed so that structure included between the gate elements 200, 202 can be seen. In particular, it can be seen in the figure that an expanding mechanism 302 is provided between the gate elements 200, 202 that is configured to expand the gate elements 200, 202 away from each other when they are deployed, so that they are pressed outwardly against the portals 108 110 and form seals therewith. In the embodiment of FIG. 3B, the expanding mechanism is a pneumatic system that includes four air-driven "opposed" pneumatic pistons 302 (i.e. double pistons that expand simultaneously in two opposite directions) located between and proximal to four opposing "corners" of the gate elements 200, 202. FIG. 3C is an enlarged view from above that shows one of the four opposed pneumatic pistons 302 in more detail. The top panel and a plurality of other structural elements have been removed from FIG. 3C so that the opposed air piston 302 and associated structures can be more clearly seen.

Accordingly, when the gate elements 200, 202 are deployed and the expanding mechanism 302 is engaged, both portals 108, 110 of the bridging module 100 are fully sealed, so that the interior of the bridging module 100 can be vented and accessed without any need to vent either of the adjoining tube segments (not shown).

As noted above, the bridging module in the illustrated embodiment further comprises a rail carriage 112 that forms a connection between the overhead capsule support rails of the adjoining tube segments 114. As is shown in FIG. 3A, when the gate elements 200, 202 are deployed, the rail carriage 112 is lifted vertically by a lifting mechanism 212 so that the gate elements 200, 202 and associated apparatus are able to pass beneath. And when the gate elements 200, 202 are returned to their stored configuration in the storage section 104, as shown in FIG. 2A, the rail carriage 212 is lowered back into position where it re-engages with the capsule support rails of the adjacent tube segments 114. In the embodiment of FIG. 2A, the rail carriage 212 operates along vertical rails 214 that run along both sides of a carriage housing that extends above the portal section 102.

In embodiments, the motors 208, 212 that drive the gate elements 200, 202 and/or the rail carriage 112 include continuous position indications and/or diagnostics that are remotely accessible, for example via Bluetooth. In embodiments, either or both of the gate elements 200, 202 and/or the rail carriage 112 include limit switches that indicate fully open and closed positions. In embodiments the continuous position indications are calibrated according to signals received from the limit switches, as is described in more detail in co-pending U.S. application Ser. No. 15/648,959, also submitted by the present Applicant, which is incorporated herein by reference in its entirety for all purposes. Embodiments include redundant limit switches so that limits are not exceeded even if one of the limit switches fails.

It should be noted that while the present invention is disclosed and described in the context of evacuated tube transportation systems, the invention as such is not limited to transportation systems, but is applicable to any circumstance where it is necessary to interconnect and reversibly isolate adjacent, large, evacuated volumes.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

We claim:

1. A bridging module configured to provide vacuum connectivity between first and second tube segments of an evacuated tube transportation system, the first and second tube segments extending in a first direction that is parallel to a local surface of the earth, the bridging module comprising:

a portal section comprising opposing first and second portals configured for sealed attachment respectively to the first and second tube segments;

first and second gate elements configured respectively to cover and seal the first and second portals, the gate elements having tops at extremities thereof that are furthest from the earth's center;

a storage section extending from the portal section in a second direction that is perpendicular to the first direction and parallel to the local surface of the earth, the gate elements being translatable in the second direction by a drive mechanism between a deployed configuration in which the gate elements are located in the portal section and form seals with the portals, and a stored configuration in which the gate elements are located in the storage section and do not overlap a passage formed between the portals; and an expanding mechanism extending between the gate elements and configured to press the gate elements apart when the gate elements are in the deployed configuration, thereby pressing the gate elements against the portals;

the bridging module thereby providing unobstructed, evacuated connectivity between the first and second tube segments when the gate elements are in the stored configuration and the first and second tube segments are evacuated; and an interior of the bridging module between the first and second portals being isolated from the tube segments when the gate elements are in the deployed configuration, thereby enabling the first and second tube segments to remain evacuated while the interior of the bridging module is vented to atmosphere.

2. The bridging module of claim 1, wherein the gate elements are supported by rails on which the gate elements are translatable in the second direction.

3. The bridging module of claim 1, wherein the gate elements are supported by linear bearings on which the gate elements are translatable in the second direction.

4. The bridging module of claim 1, wherein the gate elements are stabilized by sliding attachment of the tops thereof to rails.

5. The bridging module of claim 4, wherein the sliding attachment of the tops of the first and second tube segments to the rails includes linear bearings.

6. The bridging module of claim 1, wherein the drive mechanism includes a rack-and-pinion and a drive motor.

7. The bridging module of claim 1, wherein the drive mechanism includes a continuous position indication.

8. The bridging module of claim 1, wherein the drive mechanism includes at least one range limiting mechanism that prevents the drive mechanism from translating the gate elements beyond a defined range.

9. The bridging module of claim 1, wherein the drive mechanism includes a continuous position indication that is calibrated according to signals received from at least one range limiting mechanism that prevents the drive mechanism from translating the gate elements beyond a defined range.

10. The bridging module of claim 1, wherein the drive mechanism includes one or both of a continuous position indication and drive/lifting mechanism diagnostic information that is accessible by means of wireless communication.

11. The bridging module of claim 1, wherein the expanding mechanism is pneumatically driven.

12. The bridging module of claim 11, wherein the expanding mechanism includes four air-driven opposed pneumatic pistons located between four opposing corners of the gate elements.

13. The bridging module of claim 1, further comprising a rail carriage configured, when the gate elements are in the stored configuration, to provide rail continuity between rails that support transportation capsules within the tube segments.

14. The bridging module of claim 13, further comprising:

a rail carriage section extending beyond the portal section in a third direction that is perpendicular to the first and second directions and is directed away from the earth's core; and a lifting mechanism configured to move the rail carriage in the third direction such that the rail carriage does not obstruct the gate elements when the gate elements are in the deployed configuration.

15. The bridging module of claim 14, wherein the lifting mechanism operates along rails that extend along opposing sides of a carriage housing that is located within the rail carriage section.

16. The bridging module of claim 14, wherein the lifting mechanism includes a continuous position indication.

17. The bridging module of claim 14, wherein the lifting mechanism includes at least one range limiting mechanism that prevents the lifting mechanism from translating the rail carriage beyond a defined range.

18. The bridging module of claim 14, wherein the lifting mechanism includes a continuous position indication that is calibrated according to signals received from at least one range limiting mechanism that prevents the lifting mechanism from translating the rail carriage beyond a defined range.

19. The bridging module of claim 14, wherein the lifting mechanism includes one or both of a continuous position indication and drive/lifting mechanism diagnostic information that is accessible by means of wireless communication.

* * * * *